United States Patent [19]

Dondi

[11] Patent Number: 4,682,427

[45] Date of Patent: Jul. 28, 1987

[54] TRENCH-DIGGER IMPLEMENT CARRIED BY A LATERALLY EXTENDING BOOM AND DRIVE THEREFOR

[75] Inventor: Giuliano Dondi, Mirandola, Italy

[73] Assignee: Pietro Dondi & Figli S.r.l., Modena, Italy

[21] Appl. No.: 756,226

[22] Filed: Jul. 18, 1985

[51] Int. Cl.[4] ..... E02F 5/08

[52] U.S. Cl. ..... 37/91; 37/DIG. 17; 172/125; 172/305

[58] Field of Search ..... 37/94, 91, 189, DIG. 17; 172/305, 125

[56] References Cited

U.S. PATENT DOCUMENTS

| | | | |
|---|---|---|---|
| 2,685,751 | 8/1954 | Bain | 37/189 X |
| 2,705,379 | 4/1955 | Fruhling | 37/189 X |
| 2,969,601 | 1/1961 | McMaster | 37/94 |
| 3,028,919 | 4/1962 | Smith et al. | 37/94 X |
| 3,683,522 | 8/1972 | Rousseau et al. | 37/91 |
| 3,704,575 | 12/1972 | Daniel et al. | 37/91 X |

FOREIGN PATENT DOCUMENTS

| | | | |
|---|---|---|---|
| 1634999 | 8/1970 | Fed. Rep. of Germany | 37/91 |
| 2302386 | 9/1976 | France | 37/91 |
| 298344 | 11/1965 | Netherlands | 37/91 |
| 159767 | 12/1963 | U.S.S.R. | 37/91 |
| 302441 | 6/1971 | U.S.S.R. | 37/189 |

*Primary Examiner*—Clifford D. Crowder

*Attorney, Agent, or Firm*—Lowe, Price, LeBlanc, Becker

[57] ABSTRACT

A laterally-extending boom (1) is of a box-constructed type, and has two right angle drive gear units (19, 28) installed at either end, the first of which (19) in receipt of drive transmitted by a cardan shaft (17) from the tractor power take-off (18) which it relays through the boom via a transmission consisting of a first cardan shafts (22) and a second cardan shaft (23) and an intermediate shaft (21) journalled to the boom structure; the second cardan shaft (23) drives the second right angle gear unit, the output shaft of which drives a further cardan linkage providing the final connection to the gearbox of the trench digger (32).

2 Claims, 4 Drawing Figures

TRENCH-DIGGER IMPLEMENT CARRIED BY A LATERALLY EXTENDING BOOM AND DRIVE THEREFOR

TECHNICAL FIELD

The present invention relates to a trench digger which is carried by a laterally-extending boom provided with a drive transmission incorporating universal joints and, more particularly, to a tractor-drawn implement with trenching tools mounted on an earth digging device having a pair of wheels, or a single wheel paired with a disk, the trenching tools being arranged in V-formation and fitted to the outer end of a laterally-extending folding boom, for digging roadside ditches.

BACKGROUND ART

The transmission of the drive from the tractor power take-off through to the implement shaft which operates the two trenching tool shafts is almost exclusively by way of drive shafts of the cardan type, with double universal joints, mounted to the boom. The prior art embraces trench diggers, many of which are embodied basically as described above, that are operated by belt- or chain-drive transmissions.

Assuming overall dimension as par, the belt-driven type is capable of transmitting power of up to 60 or 7O HP; chain-driven types present the drawback of requiring forced lubrication.

Hydraulic power transmission, not yet adopted, involves difficulties of application, complicated technical requirements, and high costs.

The prior art stands in need of considerable improvement with regard to the option of replacing the conventional type of drive transmission between tractor and trench digger implements with a transmission that will not occasion the drawbacks found in the prior art.

From the foregoing, one may discern the need for a solution to the technical problem of embodying a drive system for transmission of power from a tractor power take-off to a trench digger input shaft which will be capable of transmitting higher power, up to 1OO HP and over, without belt slippage and without any requirement for forced lubrication, and in an economical manner.

DISCLOSURE OF INVENTION

The invention solves the technical problem stated above by adopting two right angle drive gear units located one inside each end of the laterally-extending boom which carries the trench digger at its far end and is mounted to the tractor-drawn trailer chassis by way of a slewing ring, and an optional sliding offset trolley.

The first such gear unit at the near end of the boom is provided with a transverse input shaft driven from the tractor power take-off by way of a telescopic drive shaft with two universal joints, whereas the second gear unit at the far end of the boom is provided with a transverse output shaft extending in the opposite direction to the input shaft of the first gear unit, which drives the input shaft of the trench digger implement gearbox. The boom is provided at a point intermediate said angle-drive gear units with a journal mounting for a longitudinal shaft, the rear end of which is connected by a drive shaft with two universal joints to the longitudinal output shaft of the first gear unit, and the fore end of which is connected by way of an identical drive shaft with two universal joints to the input shaft of the second gear unit.

Advantages afforded by the invention are those of higher power transmission options, reduced servicing requirements, ease of replacing single parts of the transmission in the event of failure or wear, marked economy considering the power that may be transmitted, unaffected performance of the implement drive system even with the boom working in angled positions (however tight the angle), and, reduced overall dimensions.

BRIEF DESCRIPTION OF THE DRAWINGS

An embodiment of the invention will now be described, by way of example, with the aid of the four accompanying sheets of drawings, in which.

BEST MODE FOR CARRYING OUT THE INVENTION

Figure 3:
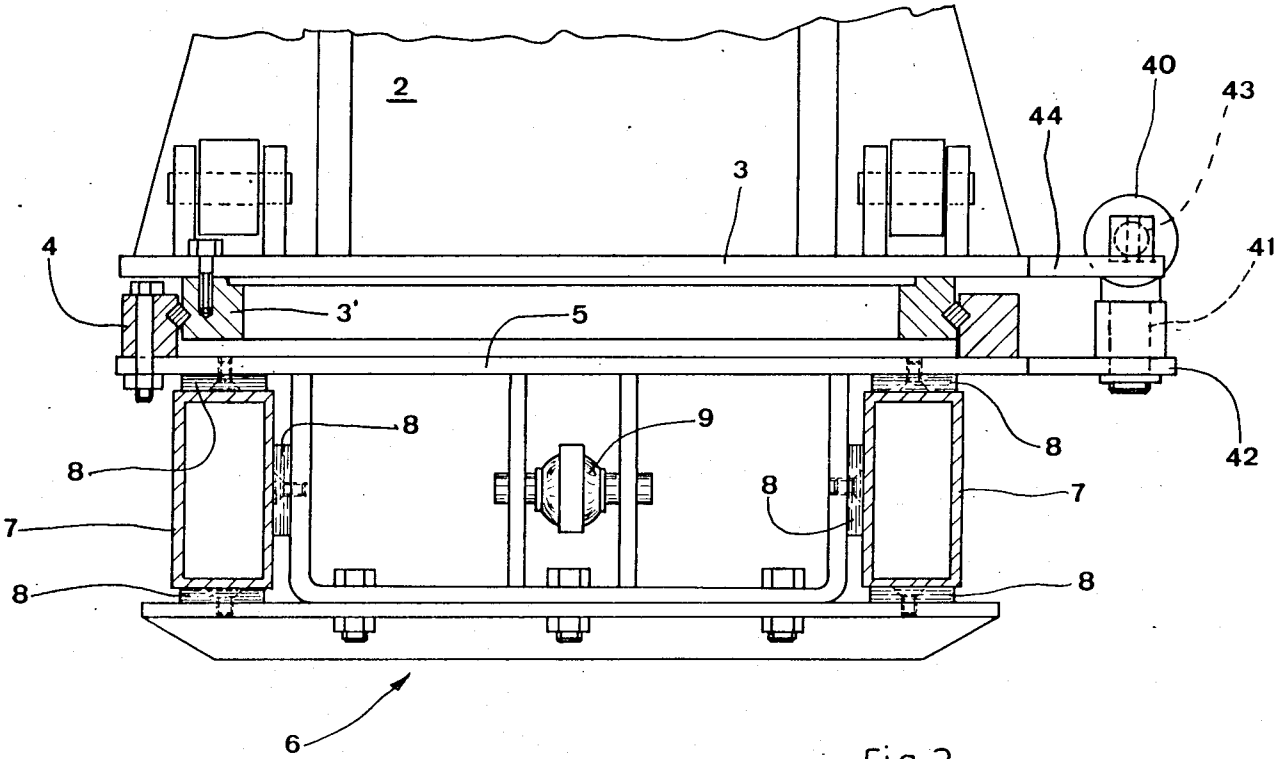
FIG. 3 is the vertical cross section through III—III in FIG. 2, seen on enlarged scale, which illustrates the trolley providing lateral displacement of the boom.
Figure 4:
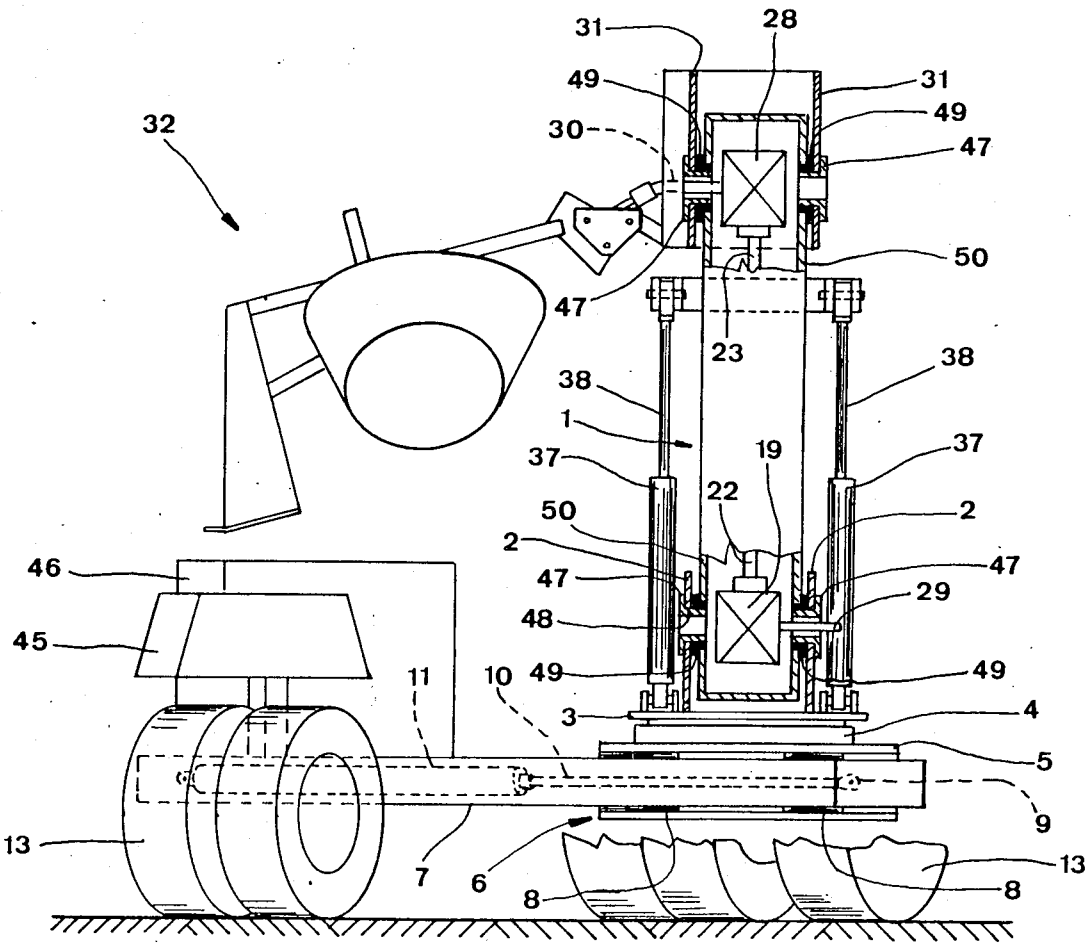
FIG. 4 is a cutaway view from the rear showing the boom retracted into the folded transit position, in which the vertical and longitudinal plane of the boom creates and angle of approximately 15° with the direction of forward movement, thereby reducing the transverse dimension of the assembly.

With reference to the drawings, 1 denotes a box-frame like structure of a laterally-extending boom which carries the implement and its transmission and is hinged to a pair of vertical plates 2 extending upwards from a platform 3 integral with the internal member 3' of a slewing ring (see FIG. 3) the external member 4 of which is integral with the frame 5 of a trolley 6 beneath.

The trolley 6 is slidable between two hollow cross-rails 7 in a direction transverse to the path of forward movement along a buffering material 8 having a low coefficient of friction located between the trolley and rails.

9 denotes the forward or distal end of the rod 10 of a hydraulic ram 11 located between the rear end of the trolley and the corresponding side of the frame 12 which carries the hollow cross-rails 7. 13 denotes the rear wheels of said frame, which is equipped at its front end by a beam hitched by way of a towing eye 14 to the drawbar 15 of the tractor 16.

17 denotes a telescopic drive shaft of the cardan type which transmits rotation from the tractor power take-off 18 to a first right angle drive gear unit 19 mounted internally of the boom structure 1, at its rear end. 20 denotes a mounting, likewise positioned internally of the boom structure and situated at a point beyond the downward bend of the boom structure 1, to which an intermediate shaft 21 is journalled in rotation and prevented thus from shifting longitudinally. 22 and 23 denote two further identical drive shafts, each of the cardan type: the first such shaft connected to the longitudinally-disposed output shaft 24 of the first gear unit 19 at one end, and to the rear end 25 of the intermediate shaft 21 at the other end; the second shaft connected to the fore end 26 of the intermediate shaft at one end and to the longitudinally-disposed input shaft 27 of the second right angle gear unit 28 at the other end, this second gear unit 28 mounted internally of the boom structure 1 at the rear end. 29 denotes the transverse input shaft of the first gear unit 19, whilst 30 denotes a transverse output shaft extending from the second gear unit 28 at the side opposite, relatively considered, to that via which shaft 29 enters the first gear unit 19, and coupled to a drive shaft with two universal joints (not shown in the drawings) which turns the input shaft of the trench digger implement gearbox.

31 denotes a pair of vertical plates extending upward from the top of the trench digger implement 32 at each side thereof, which are hinged coaxially to the output shaft 30 through an axis that coincides with the axis about which the implement proper hinges with the fore end of the boom 1.

Figure 1:
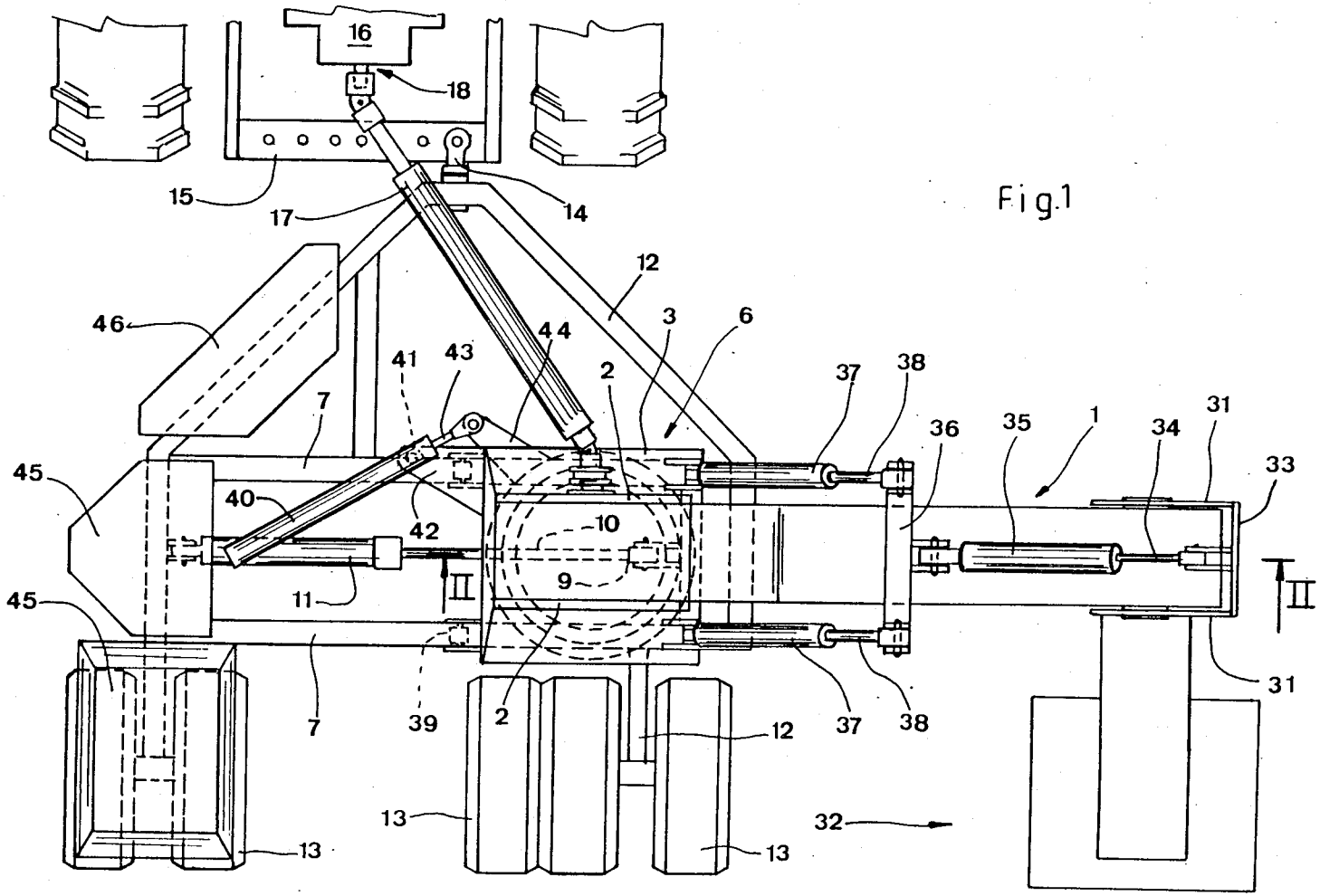
FIG. 1 is a plan view of the laterally-extending boom, located between the tractor and the trench digger implement and incorporating a drive transmission as disclosed herein.
Figure 2:
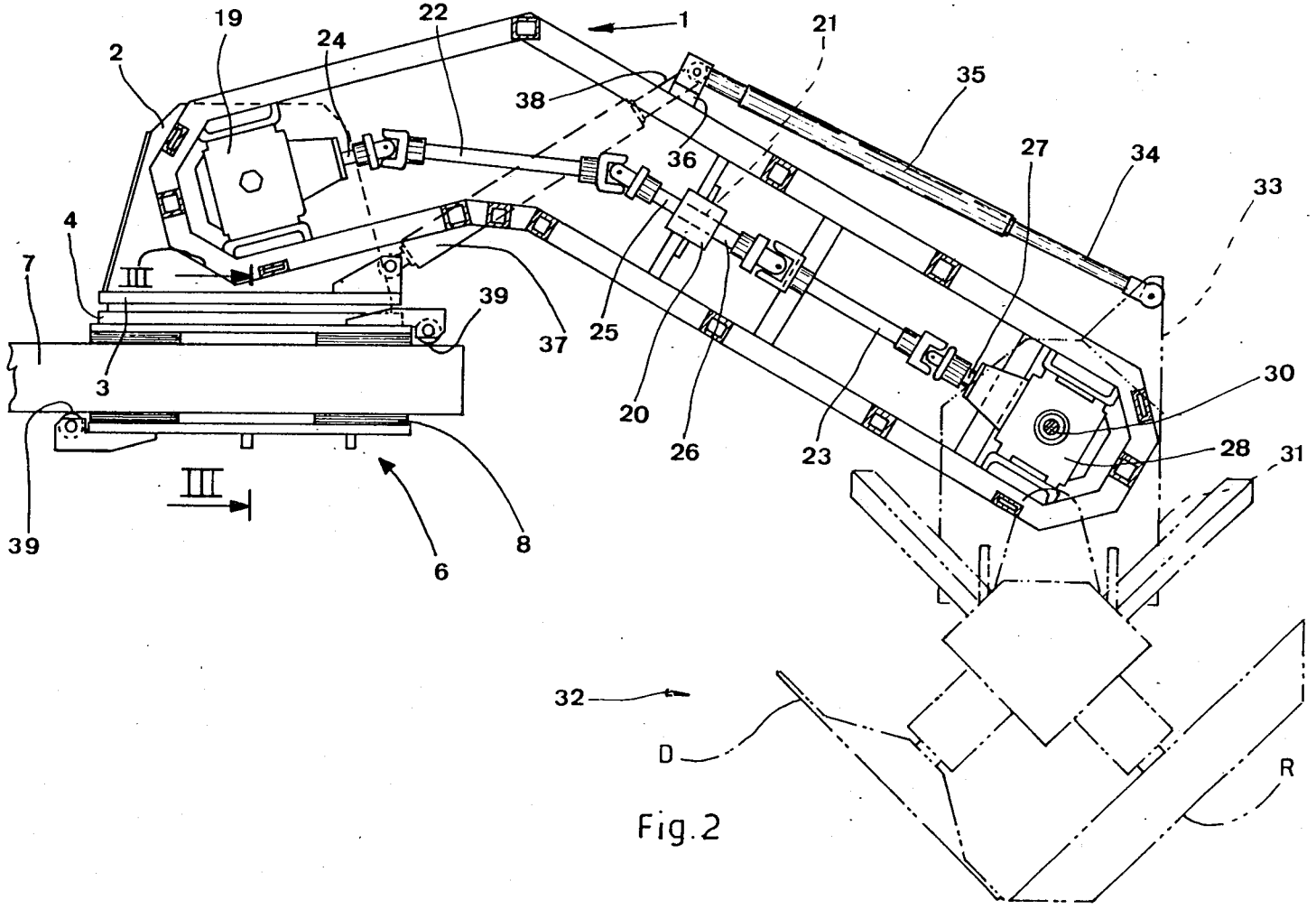
FIG. 2 is the longitudinal section through II—II in FIG. 1, seen on enlarged scale, which shows the boom in working position.

The implement illustrated in FIG. 2 is of a type having a wheel R and a disk D, and the two plates 31 are provided at the top with a lug 33 to permit hinging the fore end of the rod 34 of a hydraulic ram 35 the rear end of which is hinged to a top external cross member 36 of the boom structure 1; this ram controls sideways tilt of the implement 32.

A pair of hydraulic rams 37, the rear ends of which are hinged to the slewing ring platform 3, are located one at each side of the boom, and have their rods 38 hinged to the two ends of the cross member 36 in such a way as to lift and rotate the implement 32 about the axis or the input shaft 29 of the first gear unit 19, which is the same axis about which the entire boom 1 swings through the vertical plane; the weight of the boom 1 is counterbalanced by pairs of wheels 39 associated with the trolley 6, which engage the cross rails 7. 40 denotes a horizontally-disposed hydraulic ram which produces rotational movement of the slewing ring 3' and is located tangentially to and at one side of the platform 3, hinged to a vertical pin 41 offered by a lug 42 issuing from the frame 5 of the trolley 6, and having its rod 43 hinged to a lug 44 issuing from the slewing ring platform 3.

45 and 46 denote counterweights mounted to the trailer frame 12, which balance the dead weight carried.

A pair of opposed axially-aligned sleeves 47 located in relative holes 48 in the vertical plates 2 provide for left- or right-hand entry of the input shaft 29 of the first gear unit 19.

49 denotes a pair of opposed axially-aligned bushings located externally of and coaxial with the pair of sleeves 47 in corresponding rear holes provided in the sides 50 of the boom 1, and journalled thus in rotation to the outer surface of the sleeves 47; the sides 50 of the boom are provided with ventilation grilles not shown in the drawings. The flat head of each bushing 49 is located between a relative side 50 of the boom structure 1 and a respective vertical plate 2 extending upward from the platform 3 of the slewing ring 3'.

Identical pairs of sleeves and bushings are located between the sides 50 of the fore end of the boom and the vertical plates 31 of the implement 32.

With the engine of the tractor 16 running, and the power take-off 18 engaged, operation of the trench digger is as follows:

cardan shaft 17 turns the first right angle drive gear unit 19, thereby transmitting rotation through cardan shaft 22, intermediate shaft 21 and cardan shaft 23 to the second right angle drive gear unit 28 at the fore end of the boom, which in turn transmits rotation to the cardan shaft driving the implement 32. Having adjusted the angle of boom 1 through both the vertical and the horizontal planes, and selected the penetrating angle and tilt of the implement 32 (tilt being produced by means of a hydraulic ram disposed between the respective side of the boom 1 and the implement) the tractor can then proceed forward, adjusting the trenching depth. When carrying the invention into effect, the material, the dimension, the constructional details may all differ from those thus far illustrated, whilst remaining equivalent in terms of art and by no means straying from within the bounds of protection afforded by the present invention. For example, the trench digger might be of a type other than the implement 32 actually illustrated, perhaps with one cutting wheel only. Likewise, the trolley 6, useful as it is for offsetting the implement, might well be excluded.

I claim:

1. A trench digger implement carried by a laterally-extending boom and provided with a drive transmission having universal joints, comprising a boom (1) having a box structure mounted on a slewing ring (3') and rotatable for positioning about a vertical axis by way of a hydraulic ram (40), said slewing ring being carried by a longitudinal trolley (6) actuated by a hydraulic ram (11), wherein the boom is hinged at a rear end thereof connected to the trolley about an axis disposed transversely with respect to a longitudinal axis of the boom and driven from a power take-off (18) of a tractor (16) through a telescopic drive cardan shaft (17) having two universal joints, said implement (32) being suspended from and hinged about an axis also disposed transversely at a forward end of the boom to which said implement is connected, said boom being raised by a pair of longitudinal hydraulic rams (37), a penetrating angle defined between the rotational axis of the implement and the ground being adjusted by a longitudinal hydraulic ram (35); and further comprising two right angle drive gear units located at the rear end (19) and forward end of the boom, respectively, one inside each end of the laterally-extending boom; a first of said gear units (19) being provided with a transverse input shaft (29) located at a side of said gear unit facing the power take-off of the tractor and driven by said power take-off by way of said telescopic drive cardan shaft with said universal joints, and with a longitudinal output shaft (24); a second of said gear units (28) being provided with a longitudinal input shaft (27) and a transverse output shaft (30) which extends in the opposite direction to the input shaft of the first gear unit and drives the shaft with said universal joints driving in turn the input shaft of the implement gearbox; the boom being further provided with a longitudinal intermediate shaft (21) journalled rotatably in the boom, one end (25) of which connects by way of a drive shaft with said universal joints (22) to the longitudinal output shaft of the first gear unit, and the other end (26) of which connects by way of a drive shaft with said universal joints (23) to the input shaft of the second gear unit.

2. Trench digger as in claim 1 wherein sides (50) of the laterally-extending boom (1) flanking said angle drive gear units (19, 28) mounted within said boom are provided with holes to accommodate a pair of opposed bushings (49) with heads located between one side (50) of the boom and a plate (2) extending upward from the platform (3) of the slewing ring (3'), respectively, between said side (50) of the boom and a respective plate (31) of the implement (32); and wherein a pair of sleeves (47) is located internally of each pair of bushings, coaxial therewith, and occupying corresponding holes (48) provided in pairs of plates (2, 31) to permit left- or right-hand entry and exit of the respective input and output shaft (29, 30).

* * * * *